US006416082B1

(12) United States Patent
Gayoso

(10) Patent No.: US 6,416,082 B1
(45) Date of Patent: Jul. 9, 2002

(54) BOOK COVER AND BOOK BINDING SYSTEM USING THE BOOK COVER

(75) Inventor: Maximo Gayoso, Guadalajara Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/577,214

(22) Filed: May 23, 2000

(51) Int. Cl.[7] ..... B42D 3/00

(52) U.S. Cl. ..... 281/29; 33/113; 33/1 R; 33/700; 270/52.08; 281/15.1; 359/401; 412/4

(58) Field of Search ..... 281/15.1, 29, 34, 281/36–38; 283/63.1, 64; 270/52.08; 271/227, 255; D19/26; 206/457; 412/1, 3–5, 19; 33/1 B, 1 R, 700, 830; 356/399, 401

(56) References Cited

U.S. PATENT DOCUMENTS

| | | | | | |
|---|---|---|---|---|---|
| 1,547,082 | A | * | 7/1925 | Thomson | |
| 1,562,504 | A | * | 11/1925 | Jackson | 281/34 |
| 1,562,505 | A | * | 11/1925 | Jackson | 281/34 |
| 1,957,926 | A | * | 5/1934 | Williamson | |
| 2,375,427 | A | * | 5/1945 | Mannino | |
| 4,367,061 | A | | 1/1983 | Wiholm | 412/3 |
| 4,505,629 | A | | 3/1985 | Lynch | 412/5 |
| 4,519,630 | A | * | 5/1985 | Holmes | 281/31 |
| 4,599,798 | A | * | 7/1986 | Steele | 33/1 B |
| 4,606,689 | A | | 8/1986 | Wiholm | 412/3 |
| 4,978,267 | A | | 12/1990 | Kolkhorst | 412/21 |
| 5,318,398 | A | | 6/1994 | Kojima | 412/18 |
| 5,429,468 | A | | 7/1995 | Kojima | 412/19 |
| 5,465,213 | A | | 11/1995 | Ross | 364/468 |
| 5,470,109 | A | * | 11/1995 | Grande | 281/34 |
| 5,662,448 | A | * | 9/1997 | Graushar et al. | 412/4 |
| 5,868,539 | A | | 2/1999 | Rathert | 412/5 |
| 6,012,890 | A | | 1/2000 | Celoria Garrido | 412/19 |

FOREIGN PATENT DOCUMENTS

| | | |
|---|---|---|
| GB | 2304627 A | 3/1997 |
| WO | WO99/38707 | 8/1999 |

* cited by examiner

*Primary Examiner*—A. L. Wellington
*Assistant Examiner*—Monica Carter

(57) ABSTRACT

A book cover for binding a book block includes a cover blank, a cover image provided on the cover blank, and an alignment feature associated with the cover blank. The cover image defines an image field of the cover blank and the alignment feature is registered to a center line of the image field. As such, the cover blank can be aligned in a book binder when the book block is bound with the book cover by the book binder.

39 Claims, 5 Drawing Sheets

BOOK COVER AND BOOK BINDING SYSTEM USING THE BOOK COVER

THE FIELD OF THE INVENTION

The present invention relates generally to book binding and, more particularly, to a book cover including an alignment feature for aligning the book cover in a book binder.

BACKGROUND OF THE INVENTION

In making a book, a book block which includes a plurality of sheets of paper is typically bound with a book cover by a book binder. The book block includes a body of the book including, for example, a table of contents, text, index, etc. Typically, the book cover is one sheet or piece of material cut to a desired size and includes a cover image formed of characters and/or graphics printed on a side which forms an outer surface of the book cover.

With a conventional book binding system, the book cover is positioned in the book binder and the book block is positioned relative to the book cover such that a spine of the book block is bound with an inner surface of the book cover. Thus, positioning of the book cover in the book binder, typically requires the inner surface of the book cover to be exposed such that the spine of the book block can be correctly positioned relative to the book cover. Since the outer surface and, therefore, the cover image are not exposed or visible, aligning the book cover in the book binder is difficult. In addition, since the cover image is printed on the book cover, the cover image may be skewed or offset relative to a desired position. Once again, aligning the book cover in the book binder is difficult.

Unfortunately, with the conventional book binding system, precisely aligning the book cover in the book binder is not always possible. Thus, the book block is not always correctly positioned relative to the book cover. The book cover and, more importantly, the cover image, therefore, are not always precisely centered about the book block. As such, quality and appearance of the book are poor.

Accordingly, a need exists for aligning a book cover in a book binder prior to binding of a book block in the book cover by the book binder such that the book cover and, more specifically, a cover image are centered about the book block when the book block is bound with the book cover.

SUMMARY OF THE INVENTION

One aspect of the present invention provides a book cover including a cover blank, a cover image on the cover blank, and an alignment feature associated with the cover blank, wherein the cover image defines an image field of the cover blank, the image field has a center line, and the alignment feature is registered to the center line of the image field.

In one embodiment, the alignment feature penetrates the cover blank. In one embodiment, the cover image defines a surplus region of the cover blank beyond the image field, and the alignment feature penetrates the surplus region of the cover blank.

In one embodiment, the alignment feature includes an alignment cut provided in the cover blank. In one embodiment, the cover blank has a top edge and a bottom edge, and the alignment cut extends from one of the top edge and the bottom edge of the cover blank. In one embodiment, the image field of the cover blank has a top boundary and a bottom boundary, and the alignment cut extends from one of the top edge of the cover blank toward the top boundary of the image field and the bottom edge of the cover blank toward the bottom boundary of the image field. In one embodiment, the cover image defines a surplus region of the cover blank beyond the image field, and the alignment cut is formed in the surplus region of the cover blank.

In one embodiment, the alignment feature includes at least two locator points provided on the cover blank centered about the center line of the image field and an alignment cut formed in the cover blank centered between the locator points. In one embodiment, the cover blank has a surface, and the cover image and the locator points are printed on the surface of the cover blank. In one embodiment, the cover image defines a surplus region of the cover blank beyond the image field, and the locator points are printed in the surplus region of the cover blank and the alignment cut is formed in the surplus region of the cover blank.

In one embodiment, the cover blank has a top edge and a bottom edge, and the image field of the cover blank has a top boundary and a bottom boundary. As such, the locator points are printed between one of the top edge of the cover blank and the top boundary of the image field and the bottom edge of the cover blank and the bottom boundary of the image field, and the alignment cut extends from one of the top edge of the cover blank toward the top boundary of the image field and the bottom edge of the cover blank toward the bottom boundary of the image field.

Another aspect of the present invention provides a method of forming a book cover. The method includes the steps of providing a cover blank, providing a cover image on the cover blank, and associating an alignment feature with the cover blank, wherein the cover image defines an image field of the. cover blank, the image field has a center line, and the alignment feature is registered to the center line of the image field.

Another aspect of the present invention provides a book binding system for use with a book binder including a registering guide. The book binding system includes a cover blank, a cover image on the cover blank, and an alignment feature associated with the cover blank, wherein the cover image defines an image field of the cover blank, the image field has a center line, and the alignment feature is registered to the center line of the image field and adapted for alignment with the registering guide of the book binder.

Another aspect of the present invention provides a method of binding a book block in a book cover with a book binder including a registering guide. The method includes the steps of providing a cover blank, providing a cover image on the cover blank, associating an alignment feature with the cover blank, aligning the alignment feature with the registering guide of the book binder, positioning the book block on the cover blank, and binding the book block in the cover blank with the book binder, wherein the cover image defines an image field of the cover blank, the image field defines the book cover and has a center line, and the alignment feature is registered to the center line of the image field.

Another aspect of the present invention provides a system for producing a book on-demand. The system includes a processing system adapted to receive and process a book request for the book, a book block preparation system which prepares a book block of the book in response to a book body preparation command of the processing system, a book cover preparation system which prepares a book cover of the book in response to a book cover preparation command of the processing system, and a book finishing system which assembles the book block and the book cover to form the book. In one embodiment, the book cover includes a cover blank, a cover image on the cover blank, and an alignment feature associated with the cover blank, wherein the cover image defines an image field of the cover blank, the image field has a center line, and the alignment feature is registered to the center line of the image field. In addition, the book finishing system includes a book binder including a registering guide, wherein the alignment feature of the book cover is adapted for alignment with the registering guide of the book binder.

Another aspect of the present invention provides a method of producing a book on-demand. The method includes the steps of receiving and processing a book request for the book, preparing a book block of the book in response to a book body preparation command of the processing system, preparing a book cover of the book in response to a book cover preparation command of the processing system, and assembling the book block and the book cover to form the book. In one embodiment, the step of preparing the book cover includes providing a cover blank, providing a cover image on the cover blank, and associating an alignment feature with the cover blank, wherein the cover image defines an image field of the cover blank, the image field has a center line, and the alignment feature is registered to the center line of the image field. In addition, the step of assembling the book block and the book cover includes providing a book binder including a registering guide, aligning the alignment feature with the registering guide, positioning the book block on the cover blank, and binding the book block in the cover blank with the book binder.

The present invention provides for alignment of a book cover in a book binder prior to binding of a book block in the book cover by the book binder. Thus, the book cover and, more specifically, a cover image are centered about the book block when the book block is bound with the book cover.

BRIEF DESCRIPTION OF THE DRAWINGS

FIG. 2A illustrates one exemplary embodiment of a cover blank for forming the book cover according to the present invention;

FIG. 2B illustrates one exemplary embodiment of a cover image and an alignment feature printed on a side of the cover blank of FIG. 2A to form the book cover;

FIG. 2C illustrates one exemplary embodiment of an alignment feature formed in the cover blank of FIG. 2B;

FIG. 2D illustrates one exemplary embodiment of another side of the cover blank of FIG. 2C;

FIG. 2E illustrates one exemplary embodiment of alignment of the cover blank of FIG. 2D with a centering guide of a book binder and positioning of the book block on the cover blank;

FIG. 2F illustrates one exemplary embodiment of the book block positioned on the cover blank of FIG. 2E;

FIG. 2G illustrates one exemplary embodiment of the book block bound with the cover blank of FIG. 2F;

FIG. 2H illustrates one exemplary embodiment of the book block bound with the book cover according to the present invention.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
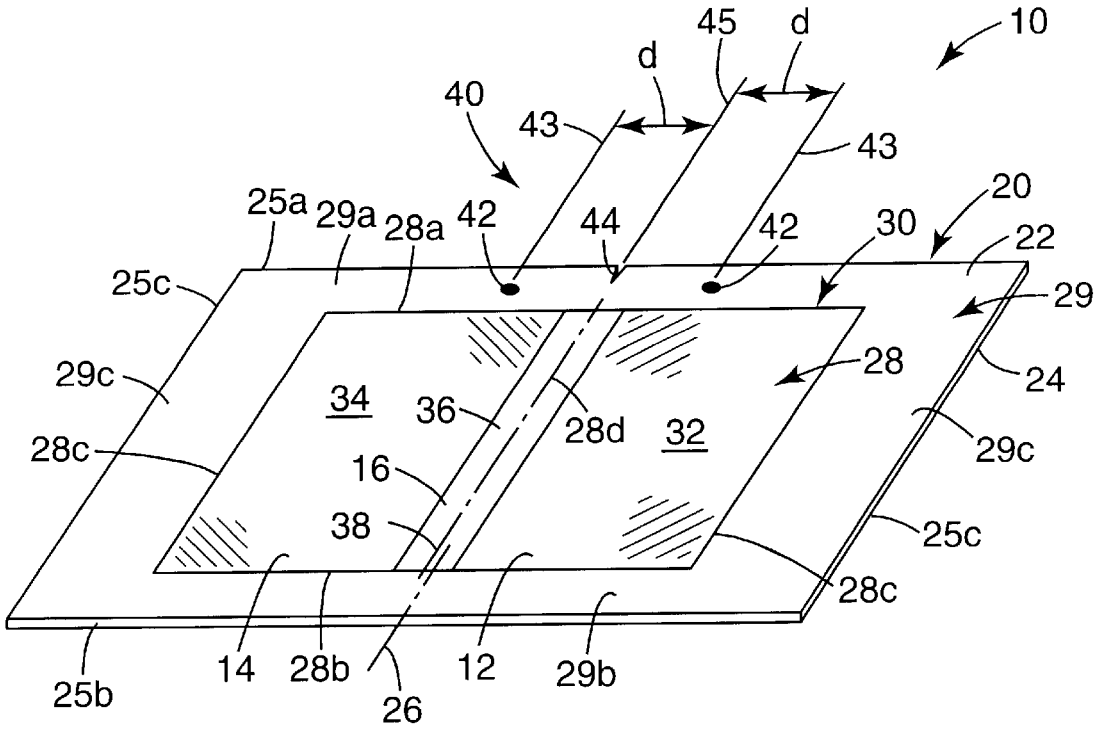
FIG. 1 illustrates one exemplary embodiment of a book cover according to the present invention.

A book cover according to the present invention is illustrated generally at 10 in FIG. 1. Book cover 10 includes a cover blank 20, a cover image 30, and an alignment feature 40. Cover blank 20 is one sheet or piece of material cut to a desired size and cover image 30 includes images in the form of characters and/or graphics as is well known in the art.

Cover blank 20 includes a top surface 22 and a bottom surface 24, and is substantially rectangular in shape. As such, cover blank 20 includes a top edge 25*a*, a bottom edge 25*b*, and a pair of side edges 25*c*. Bottom edge 25*b* is spaced from and substantially parallel with top edge 25*a*, and side edges 25*c* are substantially parallel with each other and perpendicular to top edge 25a and bottom edge 25*b*. Cover blank 20 has a center line 26 positioned equidistant between and oriented substantially parallel with side edges 25*c*. Center line 26 is also oriented substantially perpendicular to top edge 25*a* and bottom edge 25*b* so as to bisect top edge 25*a* and bottom edge 25*b*.

Cover image 30 is provided on top surface 22 of cover blank 20. As such, cover image 30 defines an image field 28 of cover blank 20. Thus, a surplus region 29 of cover blank 20 is defined beyond image field 28. In one exemplary embodiment, image field 28 includes a top boundary 28*a*, a bottom boundary 28*b*, and a pair of side boundaries 28*c*. Bottom boundary 28*b* is spaced from and substantially parallel with top boundary 28*a*, and side boundaries 28*c* are substantially parallel with each other and substantially perpendicular to top boundary 28*a* and bottom boundary 28*b*.

In one exemplary embodiment, surplus region 29 is defined around a perimeter of image field 28. As such, surplus region 29 includes a top surplus region 29*a* defined between top edge 25*a* of cover blank 20 and a top boundary 28*a* of image field 28, and a bottom surplus region 29*b* defined between bottom edge 25*b* of cover blank 20 and bottom boundary 28*b* of image field 28. In addition, surplus region 29 includes side surplus regions 29*c* defined between side edges 25*c* of cover blank 20 and side boundaries 28*c* of image field 28. Image field 28 has a center line 28*d* positioned equidistant between and oriented substantially parallel with side boundaries 28*c*. Centerline 28*d* is also oriented substantially perpendicular to top boundary 28*a* and bottom boundary 28*b* so as to bisect top boundary 28*a* and bottom boundary 28*b*.

In one exemplary embodiment, cover image 30 includes a front cover image region 32, a back cover image region 34, and a cover spine image region 36 provided between front cover image region 32 and back cover image region 34. As such, front cover image region 32 defines a front cover 12 of book cover 10, back cover image region 34 defines a back cover 14 of book cover 10, and cover spine image region 36 defines a cover spine 16 of book cover 10. Thus, width and height of front cover image region 32 and back cover image region 34 substantially coincide with a page size of a book block 50 (FIG. 2E) to be bound with book cover 10 and a width of cover spine image region 36 coincides with a thickness of book block 50.

In one exemplary embodiment, cover image 30 has a center line 38 positioned equidistant between front cover image region 32 and back cover image region 34, and centered within cover spine image region 36. Center line 38 of cover image 30 is oriented substantially parallel with side boundaries 28*c* of image field 28 and substantially perpendicular to top boundary 28*a* and bottom boundary 28*b* so as to bisect top boundary 28*a* and bottom boundary 28*b* of image field 28. Center line 38 of cover image 30, therefore, coincides with center line 28*d* of image field 28.

Center line 38 of cover image 30 and center line 28*d* of image field 28, however, do not necessarily coincide with center line 26 of cover blank 20. As illustrated in FIG. 1, for example, center line 38 of cover image 30 and center line 28*d* of image field 28 are offset from center line 26 of cover blank 20. More specifically, cover image 30 and, therefore, image field 28 are offset or shifted to the left on cover blank 20. It is understood, however, that cover image 30 and image field 28 can be offset to the right on cover blank 20 or that cover image 30 and image field 28 can be centered on cover blank 20 such that center line 38 of cover image 30 and center line 28*d* of image field 28 coincide with center line 26 of cover blank 20.

In one exemplary embodiment, front cover image region 32, back cover image region 34, and cover spine image region 36 each include images, for example, characters and/or graphics as is well known in the art. It is, however, within the scope of the present invention for at least one of front cover image region 32, back cover image region 34, and cover spine image region 36 to be blank. Image field 20, however, is sized as though front cover image region 32, back cover image region 34, and cover spine image region 36 all were provided. As such, center line 38 of cover image 30 remains centered within image field 20. In addition, if the thickness of book block 50 (FIG. 2E) is minimal, cover spine image region 36 and, therefore, cover spine 16 can be excluded.

In one exemplary embodiment, alignment feature 40 includes at least two locator points 42 and an alignment cut 44. Locator points 42 are provided on top surface 22 of cover blank 20 and alignment cut 44 is provided in cover blank 20. Thus, alignment cut 44 penetrates cover blank 20 so as to be readily sensed from both top surface 22 and bottom surface 24 of cover blank 20.

In one exemplary embodiment, locator points 42 are provided on opposite sides of center line 28*d* of image field 28. Locator points 42 each have a center line 43 oriented parallel to center line 28*d* of image field 28 and, therefore, center line 38 of cover image 30. Thus, locator points 42 are registered to center line 28*d* of image field 28 and, therefore, center line 38 of cover image 30. More specifically, center line 43 and, therefore, locator points 42 are spaced a predetermined distance from center line 28*d* of image field 28, as represented by distance d in FIG. 1. While only two locator points 42 are illustrated, it is within the scope of the present for additional locator points to be provided. Providing at least two locator points 42 registered to center line 28*d* of image field 28 locates both an x-axis and a y-axis of cover image 30 relative to cover blank 20.

In one exemplary embodiment, alignment cut 44 is provided between locator points 42. Alignment cut 44 has a center line 45 oriented parallel to center line 43 of locator points 42. As such, alignment cut 44 is registered to locator points 42. Thus, alignment cut 44 is registered to center line 28*d* of image field 28 and, therefore, center line 38 of cover image 30. More specifically, center line 45 and, therefore, alignment cut 44, is spaced a predetermined distance from center line 43 of locator points 42, as represented by distance d in FIG. 1. Thus, center line 45 of alignment cut 44 coincides with center line 28*d* of image field 28 and, therefore, center line 38 of cover image 30. As such, alignment cut 44 is centered between locator points 42 and identifies center line 28*d* of image field 28.

While locator points 42 and alignment cut 44 are centered about center line 28*d* of image field 28 as represented by distance d, it is within the scope of the present invention for locator points 42 and alignment cut 44 to be offset a predetermined distance from center line 28*d* of image field 28. More specifically, while distances d are illustrated as being equal distances, it is within the scope of the present invention for distances d to be unequal predetermined distances. Thus, locator points 42 and alignment cut 44 remain registered to center line 28*d* of image field 28 and, therefore, center line 38 of cover image 30.

In one exemplary embodiment, locator points 42 are provided in surplus region 29 and alignment cut 44 is formed in surplus region 29. More specifically, locator points 42 are provided between top edge 25*a* of cover blank 20 and top boundary 28*a* of image field 28, and alignment cut 44 extends from top edge 25*a* of cover blank 20 toward top boundary 28*a* of image field 28. Thus, locator points 42 are provided in top surplus region 29*a* of surplus region 29 and alignment cut 44 is formed in top surplus region 29*a* of surplus region 29. It is, however, within the scope of the present invention for locator points 42 and/or alignment cut 44 to be provided in bottom surplus region 29*b* of surplus region 29.

Figure 2A:
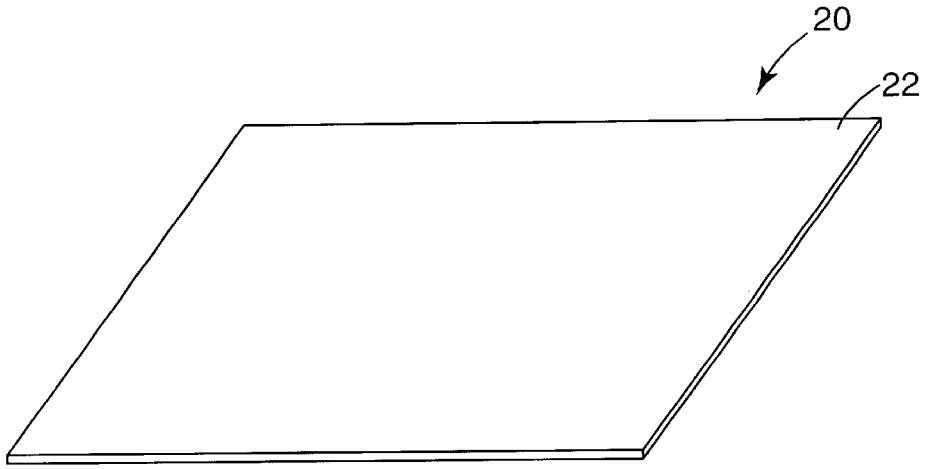
FIGS. 2A–2H illustrate one exemplary embodiment of a method of forming a book cover and binding a book block with the book cover according to the present invention.

FIGS. 2A through 2H illustrate one exemplary embodiment of a method of forming book cover 10 and binding book block 50 with book cover 10. To form book cover 10, cover blank 20 is provided, as illustrated in FIG. 2A.

Cover blank 20 includes any type of sheet material such as paper, cardboard and/or plastic film suitable for forming book cover 10. Thickness of cover blank 20 can vary according to a desired durability of book cover 10. Thickness of book cover 20 can include, for example, 8, 10, or 12 mil.

Figure 2B:
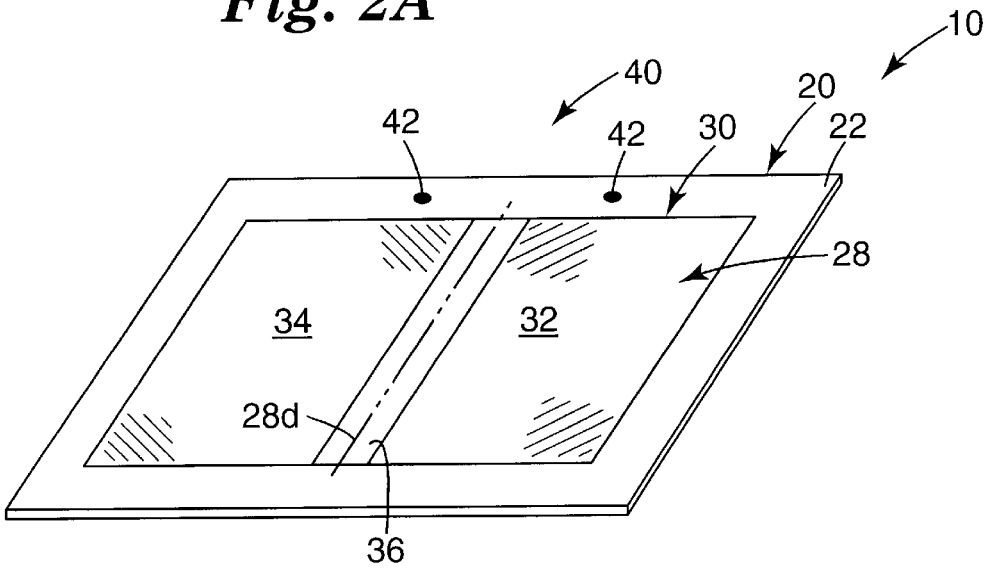

Next, cover image 30 and locator points 42 are provided on top surface 22 of cover blank 20, as illustrated in FIG. 2B. Thus, top surface 22 of cover blank 20 forms an outer surface of book cover 10. In one exemplary embodiment, cover image 30 including front cover image region 32, rear cover image region 34, and cover spine image region 36, as well as locator points 42 are printed on cover blank 20 by, for example, an ink jet printing system (not shown) or any other type of printing system known in the art. Locator points 42 are centered about center line 28*d* of image field 28 (FIG. 1). While locator points 42 are illustrated as being in the form of dots, it is within the scope of the present invention for locator points 42 to be of any shape and/or size. In addition, a size of cover image 30 can vary relative to a size of cover blank 20 according to a size of book block 50.

Figure 2C:
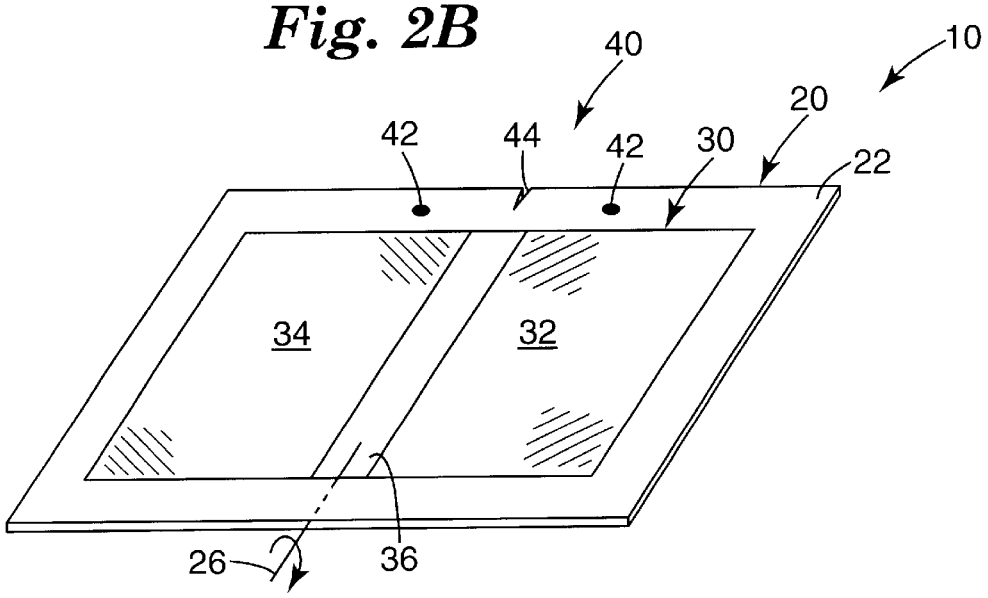

Next, alignment cut 44 is formed in cover blank 20, as illustrated in FIG. 2C. Thus, alignment cut 44 is readily sensed from both top surface 22 and bottom surface 24 of cover blank 20. In one exemplary embodiment, alignment cut 44 is formed by sensing locator points 42 and forming alignment cut 44 therebetween so as to penetrate cover blank 20. Sensing locator points 42 25 includes visual sensing performed manually or by an optical sensor (not shown).

Forming alignment cut 44 is performed by a knife (not shown) or any other type of sharp instrument known in the art. Alignment cut 44 is centered between locator points 42 and, therefore, centered about center line 28*d* of image field 28 (FIG. 1). While alignment cut 44 is illustrated as being substantially V-shaped, it is within the scope of the present invention for alignment cut 44 to be of any shape or size.

Figure 2D:
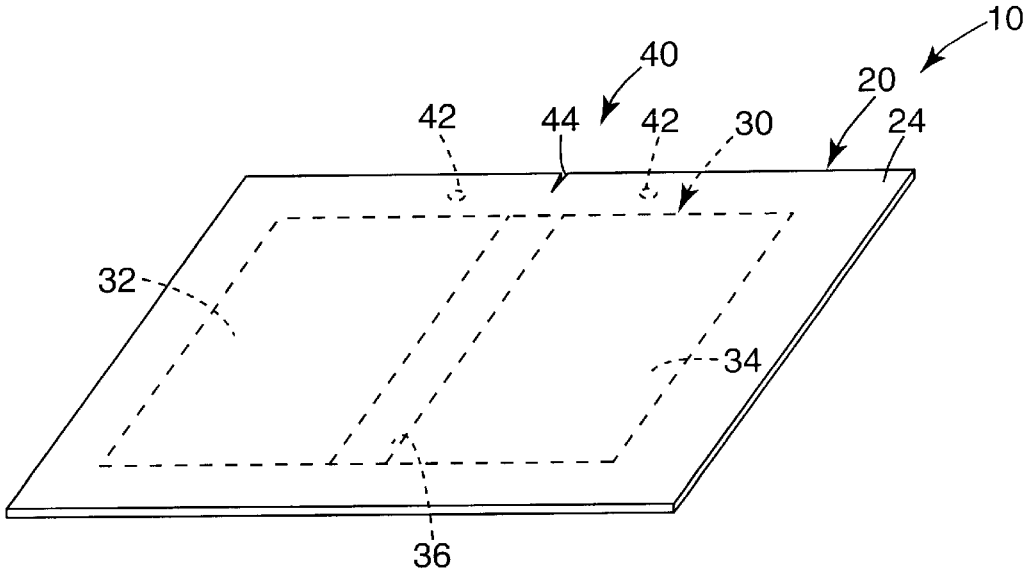

Then, as also illustrated in FIG. 2C, cover blank 20 is rotated about center line 26 such that bottom surface 24 is directed upward, as illustrated in FIG. 2D. As such, cover image 42 and locator points 44 are directed downward. Thus, cover image 42 and locator points 44 are no longer visible. Alignment cut 44, however, remains visible.

Figure 2E:
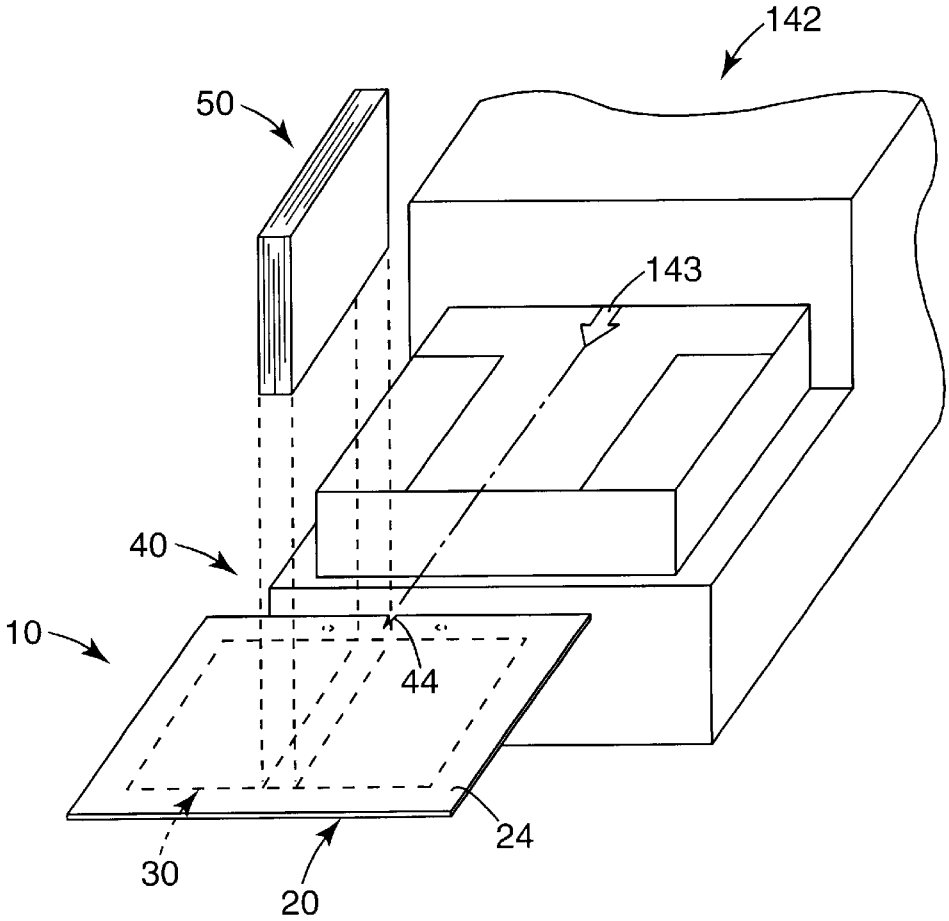

With alignment cut 44 visible, book cover 10 is positioned in a book binder 142 by aligning alignment cut 44 with a registering guide 143 of book binder 142, as illustrated in FIG. 2E. As such, image field 28 and, therefore, cover image 30 are registered with registering guide 143 of book binder 142. Registering guide 143 includes, for example, indicia in the form of a symbol or character, a raised or recessed feature, and/or any other type of identifying mark. Book block 50 is positioned on cover blank 20 and bound with book cover 10 by book binder 142 as is well known in the art. Examples of book binder 142 include a DB-250 Desktop Perfect Binder, manufactured by Duplo and a BQ-140 Perfect Binder, manufactured by Standard/Horizon.

Figure 2F:
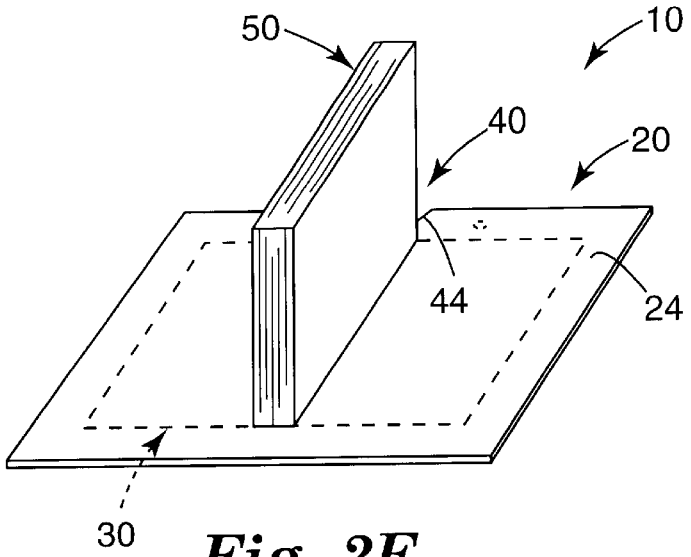
Figure 2G:
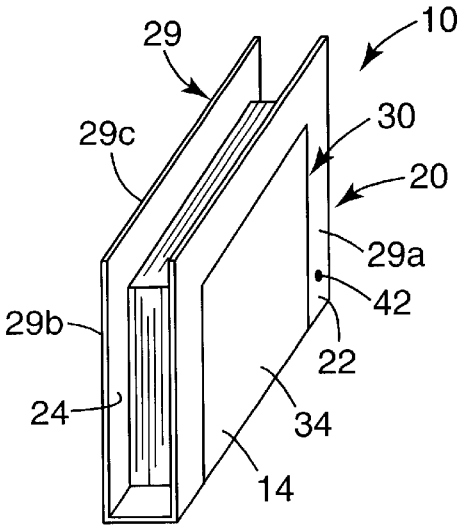
Figure 2H:
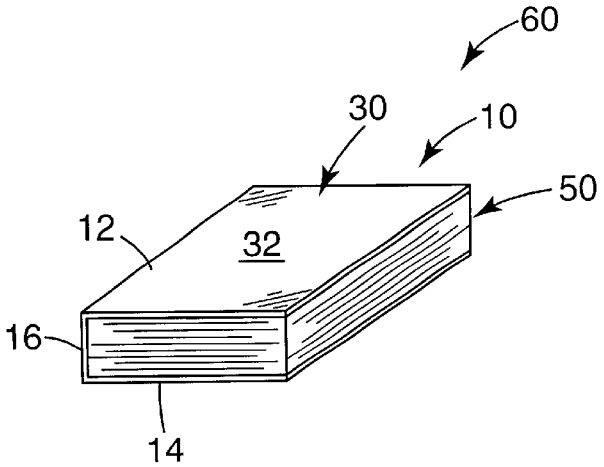

When book block 50 is bound with book cover 10, bottom surface 24 of cover blank 20 forms an inner surface of book cover 10 such that cover image 30 is centered about book block 50, as illustrated in FIG. 2F. In addition, surplus region 29 extends beyond book block 50, as illustrated in FIG. 2G. Thus, surplus region 29, including alignment feature 40, is trimmed from book block 50 resulting in a book 60, as illustrated in FIG. 2H. Surplus region 29 is trimmed, for example, by making three separate cuts (one for top surplus region 29*a*, one for bottom surplus region 29*b*, and one for side surplus regions 29*c*) or one single cut.

With alignment feature 40, book cover 10 ensures that cover image 30 will be centered about book block 50 when book block 50 is bound with book cover 10. Thus, misalignment between book cover 10 and book block 50 during binding is avoided.

Figure 3:
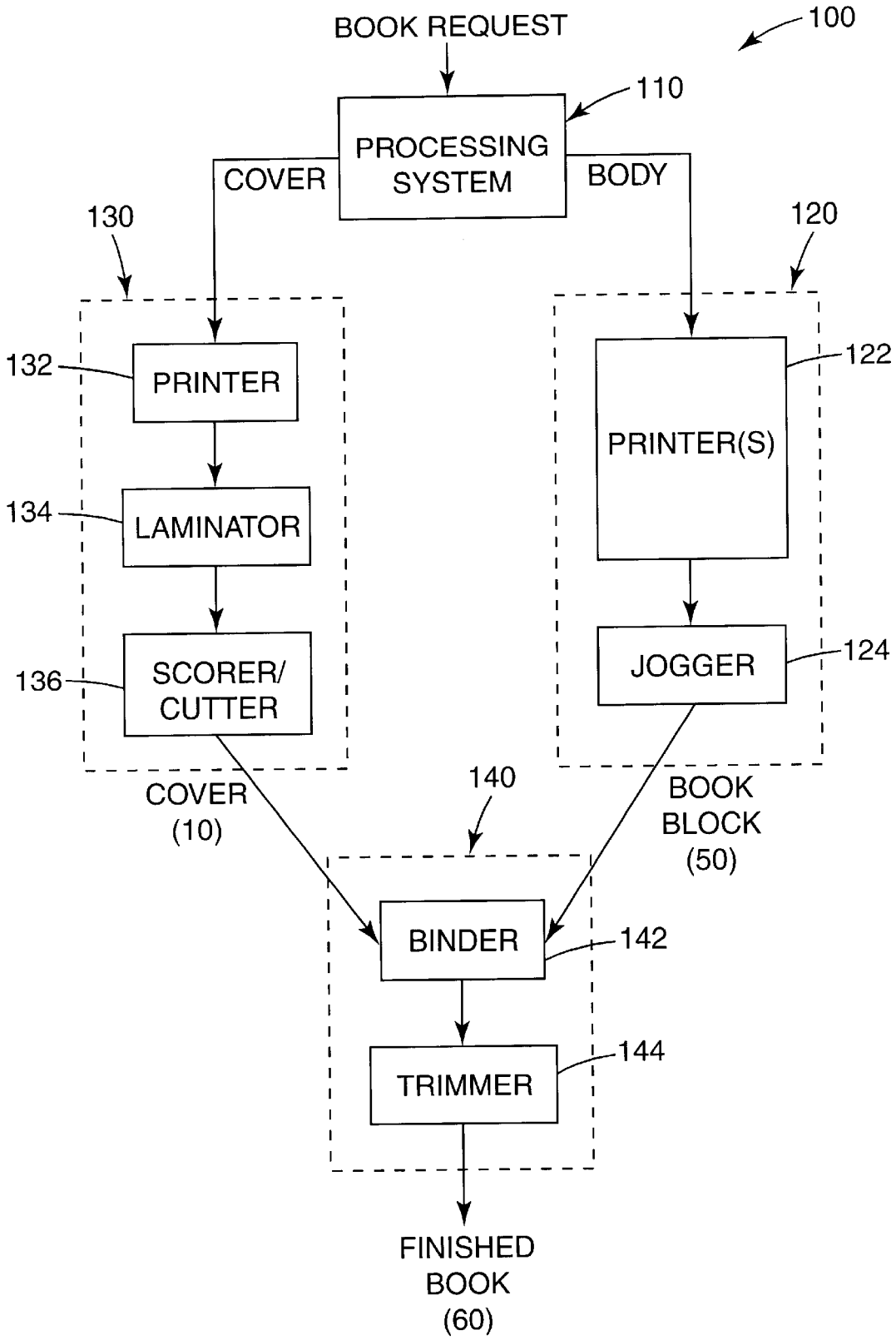
FIG. 3 is a block diagram illustrating one exemplary embodiment of a books-on-demand system according to the present invention which includes the book cover of FIG. 1.

In one illustrative embodiment, book cover 10 is formed in a books-on-demand system illustrated generally at 100 in FIG. 3. Books-on-demand system 100 receives orders for single and/or multiple copies of a book and produces the book on-demand. More specifically, books-on-demand system 100 retrieves an electronic file of the book and then prints and binds a copy of the book.

In one exemplary embodiment, books-on-demand system 100 includes a processing system 110, a book block preparation system 120, a book cover preparation system 130, and a book finishing system 140. In one exemplary embodiment, processing system 110 includes hardware and software for receiving and processing a book request. Processing system 110 retrieves an electronic file of a book being requested and produces a print command for a body of the book including, for example, a table of contents, the text, and an index, and produces a print command for a cover of the book. In response to the print commands, book block preparation system 120 and book cover preparation system 130 prepare book block 50 and book cover 10, respectively. Thereafter, book finishing system 140 assembles book block 50 and book cover 10 to form book 60.

In one exemplary embodiment, book block preparation system 120 includes one or more printers 122 and a jogger 124. Printer 122 is a black and white printer and prints the body of book 60 on several sheets of paper. Jogger 124 vibrates or shakes the sheets to align the edges of the paper in forming book block 50.

In one exemplary embodiment, book cover preparation system 130 includes a printer 132, a laminator 134, and a scorer/cutter 136. Printer 132 is a color printer and prints book cover 10 including cover image 30 and locator points 42 as described above (FIG. 2B). Laminator 134 laminates cover blank 20 and scorer/cutter 136 scores cover blank 20 with crease lines which facilitate bending along a spine of book block 50. Scorer/cutter 136 also forms alignment cut 44 in cover blank 20 as described above (FIG. 2C).

In one exemplary embodiment, book finishing system 140 includes book binder 142 and a book trimmer 144. As such, cover blank 20 is registered in book binder 142 by aligning alignment cut 44 with registering guide 143, as described above (FIG. 2E). Then, book block 50 is positioned on cover blank 20 and bound with book cover 10 by book binder 142 as is well known in the art. Thereafter, book trimmer 144 trims cover blank 20, as described above (FIG. 2H). Thus, finished book 60 is produced.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A book cover, comprising:

a cover blank having an inner surface and an outer surface opposite the inner surface;

a cover image provided on the outer surface of the cover blank and defining an image field on the outer surface of the cover blank and a surplus region of the cover blank located around the outer perimeter of the image field, the image field having a center line; and an alignment feature associated with the inner surface and the outer surface of the cover blank and registered to tie center line of the image field, wherein the alignment feature is confined only to the surplus region of the cover blank.

2. The book cover of claim 1, wherein the alignment feature penetrates the cover blank.

3. The book cover of claim 1, wherein the alignment feature penetrates the surplus region of the cover blank.

4. The book cover of claim 1, wherein the alignment feature includes an alignment cut provided in the cover blank.

5. The book cover of claim 4, wherein the cover blank has a top edge and a bottom edge, and wherein the alignment cut extends from one of the top edge and the bottom edge of the cover blank.

6. The book cover of claim 5, wherein the image field of the cover blank has a top boundary and a bottom boundary, and wherein the alignment cut extends from one of the top edge of the cover blank toward the top boundary of the image field and the bottom edge of the cover blank toward the bottom boundary of the image field.

7. The book cover of claim 4, wherein the alignment cut is formed in the surplus region of the cover blank.

8. The book cover of claim 1, wherein the alignment feature includes at least two locator points provided on the cover blank centered about the center line of the image field and an alignment cut formed in the cover blank centered between the locator points.

9. The book cover of claim 8, wherein the cover image and the locator points are printed on the outer surface of the cover blank.

10. The book cover of claim 9, wherein the locator points are printed in the surplus region of the cover blank and the alignment cut is formed in the surplus region of the cover blank.

11. The book cover of claim 8, wherein the cover blank has a top edge and a bottom edge, wherein the image field of the cover blank has a top boundary and a bottom boundary, wherein the locator points are printed between one of the top edge of the cover blank and the top boundary of the image field and the bottom edge of the cover blank and the bottom boundary of the image field, and wherein the alignment cut extends from one of the top edge of the cover blank toward the top boundary of the image field and the bottom edge of the cover blank toward the bottom boundary of the image field.

12. A method of forming a book cover, the method comprising the steps of:

providing a cover blank having an inner surface and an outer surface opposite the inner surface;

providing a cover image on the outer surface of the cover blank, including defining an image field on the outer surface of the cover blank and a surplus region of the cover blank located around the outer perimeter of the image field, the image field having a center line; and associating an alignment feature with the inner surface and the outer surface of the cover blank, including registering the alignment feature to the center line of the image field and confining the alignment feature only to the surplus region of the cover blank.

13. The method of claim 12, wherein the step of associating the alignment feature with the cover blank includes penetrating the cover blank.

14. The method of claim 12, wherein the step of associating the alignment feature with the cover blank includes penetrating the surplus region of the cover blank.

15. The method of claim 12, wherein the step of associating the alignment feature with the cover blank includes providing an alignment cut in the cover blank.

16. The method of claim 15, wherein the cover blank has a top edge and a bottom edge, and wherein the step of associating the alignment feature with the cover blank includes providing the alignment cut from one of the top edge and the bottom edge of the cover blank.

17. The method of claim 16, wherein the image field of the cover blank has a top boundary and a bottom boundary, and wherein the step of associating the alignment feature with the cover blank includes extending the alignment cut from one of the top edge of the cover blank toward the top boundary of the image field and the bottom edge of the cover blank toward the bottom boundary of the image field.

18. The method of claim 15, wherein the step of associating the alignment feature with the cover blank includes fang the alignment cut in the surplus region of the cover blank.

19. The method of claim 12, wherein the step of associating the alignment feature with the cover blank includes providing at least two locator points on the cover blank centered about the center line of the image field and forming an alignment cut in the cover blank centered between the locator points.

20. The method of claim 19, wherein the step of providing the cover image on the cover blank includes printing the cover image on the outer surface of the cover blank, and wherein the step of associating the alignment feature with the cover blank includes printing the locator points on the outer surface of the cover blank.

21. The method of claim 20, wherein the step of associating the alignment feature with the cover blank includes printing the locator points in the surplus region of the cover blank and forming the alignment cat in the surplus region of the cover blank.

22. The method of claim 19, wherein the cover blank has a top edge and a bottom edge, wherein the image field has a top boundary and a bottom boundary, and wherein the step of associating the alignment feature with the cover blank includes printing the locator points between one of the top edge of the cover blank and the top boundary of the image field and the bottom edge of the cover blank and the bottom boundary of the image field, and extending the alignment cut from one of the top edge of the cover blank toward the top boundary of the image field and the bottom edge of the cover blank toward the bottom boundary of the image field.

23. A book binding system for use with a book binder including a registering guide, the book binding system comprising:

a cover blank having an inner surface and an outer surface opposite the inner surface;

a cover image provided on the outer surfact of the cover blank and defining an image field on the outer surface of the cover blank and a surplus region of the cover blank located around the outer perimeter of the image field, the image field having a center line; and an alignment feature associated with the inner surface and the outer surface of the cover blank and registered to the center line of the image field and confined only to the surplus region of the cover blank, the alignment feature adapted for alignment with the registering guide of the book binder.

24. The book binding system of claim 23, wherein the alignment feature penetrates the cover blank.

25. The book binding system of claim 23, wherein the alignment feature penetrates the surplus region of the cover blank.

26. The book binding system of claim 23, wherein the alignment feature includes an alignment cut provided in the cover blank.

27. The book binding system of claim 26, wherein the cover blank has a top edge and a bottom edge, and wherein the alignment cut extends from one of the top edge and the bottom edge of the cover blank.

28. The book binding system of claim 27, wherein the image field of the cover blank has a top boundary and a bottom boundary, and wherein the alignment cut extends from one of the top edge of the cover blank toward the top boundary of the image field and the bottom edge of the cover blank toward the bottom boundary of the image field.

29. The book binding system of claim 26, wherein the alignment cut is formed in the surplus region of the cover blank.

30. A method of binding a book block in a book cover with a book binder including a registering guide, the method comprising the steps of:

providing a cover blank having an inner surface and an outer surface opposite the inner surface;

providing a cover image on the outer surface of the cover blank, including defining an image field on the outer surface of the cover blank and a surplus region of the cover blank located around the outer perimeter of the image field, the image field defining the book cover and having a center line;

associating an alignment feature with the inner surface and the outer surface of the cover blank, including registering the alignment feature to the center line of the image field and confining the alignment feature only to the surplus region of the cover blank;

aligning the alignment feature with the registering guide of the book binder, positioning the book block on the inner surface of the cover blank; and binding the book block in the cover blank with the book binder.

31. The method of claim 30, wherein the step of associating the alignment feature with the cover blank includes penetrating the cover blank.

32. The method of claim 30, wherein the step of associating the alignment feature with the cover blank includes penetrating the surplus region of the cover blank.

33. The method of claim 30, wherein the step of providing the cover image on the cover blank includes printing the cover image on the outer surface of the cover blank, and wherein the step of aligning the alignment feature with the registering guide of the book binder includes orienting the cover blank with the outer surface directed substantially downward.

34. The method of claim 30, wherein the step of associating the alignment feature with the cover blank includes providing an alignment cut in the cover blank.

35. The method of claim 34, wherein the cover blank has a top edge and a bottom edge, and wherein the step of associating the alignment feature with the cover blank includes providing the alignment cut from one of the top edge and the bottom edge of the cover blank.

36. The method of claim 35, wherein the image field of the cover blank has a top boundary and a bottom boundary, and wherein the step of associating the alignment feature with the cover blank includes extending the alignment cut from one of the top edge of the cover blank toward the top boundary of the image field and the bottom edge of the cover blank toward the bottom boundary of the image field.

37. The method of claim 34, wherein the step of associating the alignment feature with the cover blank includes forming the alignment cut in the surplus region of the cover blank.

38. A system for producing a book on-demand, the system comprising:

a processing system adapted to receive and process a book request for the book, the processing system adapted to retrieve a data file which includes contents of the book and produce a book body preparation command and a book cover preparation command from the data file;

a book block preparation system which prepares a book block of the book in response to the book body preparation command;

a book cover preparation system which prepares a book cover of the book in response to the book cover preparation command; and a book finishing system which assembles the book block and the book cover to form the book, wherein the book cover includes a cover blank having an inner surface and an outer surface opposite the inner surface, a cover image provided on the outer surface of the cover blank, and an alignment feature associated with the inner surface and the outer surface of the cover blank, the cover image defining an image field on the outer surface of the cover blank and a surplus region of the cover blank located around the outer perimeter of the image field, the image field having a center line, and the alignment feature being registered to the center line of the image field and confined only to the surplus region of the cover blank, and wherein the book finishing system includes a book binder including a registering guide, the alignment feature of the book cover being adapted for alignment with the registering guide of the book binder.

39. A method of producing a book on-demand, the method comprising the steps of:

receiving and processing a book request for the book including retrieving a data file which includes contents of the book and producing a book body preparation command and a book cover preparation command from the data file;

preparing a book block of the book in response to the book body preparation command;

preparing a book cover of the book in response to the book cover preparation command; and assembling the book block and the book cover to form the book, wherein the step of preparing the book cover includes providing a cover blank having an inner surface and an outer surface opposite the inner surface, providing a cover image on the outer surface of the cover blank, and associating an alignment feature with the inner surface and the outer surface of the cover blank, the cover image defining an image field on the outer surface of the cover blank and a surplus region of the cover blank located around the outer perimeter of the image field, the image field having a center line, and the alignment feature being registered to the center line of the image field and confined only to the surplus region of the cover blank, and wherein the step of assembling the book block and the book cover includes providing a book binder including a registering guide, aligning the alignment feature with the registering guide, positioning the book block on the inner surface of the cover blank, and binding the book block in the cover blank with the book binder.

* * * * *